United States Patent [19]

Rogers

[11] Patent Number: 4,955,159

[45] Date of Patent: Sep. 11, 1990

[54] RETAINING CATCH FOR TIP-OUT SASH

[75] Inventor: Tracy G. Rogers, Rochester, N.Y.

[73] Assignee: Schlegel Corporation, Rochester, N.Y.

[21] Appl. No.: 378,969

[22] Filed: Jul. 12, 1989

[51] Int. Cl.[5] ..... E05D 15/22

[52] U.S. Cl. ..... 49/161; 49/175; 49/176; 49/185; 49/187; 292/226; 292/269; 292/DIG. 20; 292/DIG.47

[58] Field of Search ..... 49/161, 175, 176, 183, 49/184, 185, 186, 187, 394, 449; 292/DIG. 47, DIG. 20, DIG. 7, 266, 264, 226, 263

[56] References Cited

U.S. PATENT DOCUMENTS

| | | | |
|---|---|---|---|
| 3,930,336 | 1/1976 | Ruggieri, Jr. | 49/161 |
| 4,475,311 | 10/1984 | Gibson | 49/176 |
| 4,605,252 | 8/1986 | Yamamoto | 292/338 |
| 4,620,393 | 11/1986 | Stafset | 49/394 |
| 4,622,778 | 11/1986 | Simpson | 49/161 |
| 4,691,950 | 9/1987 | Mayer | 292/269 |

*Primary Examiner*—Philip C. Kannan

*Attorney, Agent, or Firm*—Eckert Seamans Cherin & Mellott

[57] ABSTRACT

A retaining catch for a tip-out sash provides an automatically deployed retainer mechanism for a sash slidably captive in a window frame or jamb. The sash can be raised and lowered by sliding it along the jamb. A releasable tenon, for example at the top edge of the sash, allows the user to rotate the sash out of the plane of the jamb, facilitating cleaning of the outside. Releasing the sash from the jamb by releasing the tenon activates a mechanism with a distal hook by which the edge of the sash remains captive and displacement of the edge of the sash from the jamb is limited to the unfolded length of the mechanism. The mechanism can be released fully from the jamb by manual action of the user, whereupon the hook returns under spring bias to reside along the edge of the sash.

30 Claims, 6 Drawing Sheets

RETAINING CATCH FOR TIP-OUT SASH

BACKGROUND OF THE INVENTION

1. Field of the Invention

This invention relates to the field of tip-out sashes, namely window sashes and the like which are alternatively slidable in a jamb and rotatable out of the plane of the jamb. More particularly the invention relates to such a device wherein an automatically-deployed retaining apparatus on the tip-out sash fixes a free edge of the sash to the jamb when the edge is spaced from the jamb, until fully released by positive action of the user.

2. Prior Art

Tip-out sashes are known wherein overlapping sashes (i.e., movable panels) of a window, door or the like, which normally slide up and down (or back and forth) over one another in complementary inward-facing grooves of a jamb (e.g., window frame), are arranged such that the sash is fixed in the grooves of the jamb only at upper and lower lateral fixing pins, usually at the corners of the sash. At least one edge of the sash can be released from the jamb by linearly retracting the lateral fixing pins or other fixing means at said corners. In that event, the sash is fixed to the jamb only at the remaining lateral fixing pins and can be rotated out of the plane of the jamb around an axis defined said remaining lateral pins. Normally the pins at the upper edge are retracted, allowing the sash to rotate inwardly around the pins at the bottom edge.

Resiliently-mounted tenons can be provided as the fixing pins at the removable edge of the sash. Fixed pins can be provided at the pivot edge, the tenons and fixed pins fitting into the channels facing inwardly along either side of the jamb. Typically, a spring biased manually retractable tenon is provided at each of the two opposite lateral corners of the sash at an upper edge, and at the lower edge fixed rotary pins or sliding fittings define the pivoting axis when the sash is released from the jamb.

Tip-out sashes are useful to facilitate washing the glass on the outer face of the sash while remaining inside the building. Tipping the sash inwardly of the window turns the outer face of the window upward for easy cleaning, thereby avoiding the inconvenience of scaffolds, ladders, etc.

It is possible to locate a fixed pin midway along each lateral side of the sash, with retractable tenons at the top and/or bottom. Such a device is difficult to operate if retractable pins are provided at top and bottom, and is not secure if either is omitted. A person who operates a tip-out sash with the retractable tenon at the top and fixed pin at the bottom, however, must support the weight of the sash when the releasable edge of the sash is disengaged from the jamb. As a function of the cosine of the angle at which the sash is tipped, a greater or lesser proportion of the weight of the entire sash must be borne by the user. When tipped fully horizontally, the user must support nearly the entire weight of the sash. At times, a user will miscalculate the weight of the sash when tipping it out, particularly with multi-pane thermal sashes, counterbalanced sashes, etc., and the user may have difficulty in controlling the sash due to its unexpected weight. In that case, the sash can be dropped, with damage to the sash and possible injury to the user.

Any lack of control of a tip-out sash of course is aggravated in larger windows as compared to smaller ones. In addition to the problem of a user underestimating the sash weight, there is a problem that the weight load of the sash may deform the jamb. The weight of the upper sash is supported by the window frame or jamb when the sash is fixed in place. There is then a tendency for the two vertical members defining the sides of the jamb to bow outwardly. This outward bow defines its maximum clearance with the sash at a midpoint between the top and bottom of the jamb, the midpoint unfortunately corresponding to the locations of the retractable tenons or fixed pins of the sashes. In a sufficiently large window, without adequate support, outward lateral bowing of the jamb may cause an edge of a tip-out sash to be released from the jamb and dropped, especially with other loads occurring on the building, such as settling, wind action, etc. In case of a large jamb or with people nearby, such a release can cause severe damage.

According to the present invention, an automatically deployed linkage is provided to hook the free edge of the sash to the jamb at a preliminary position when the tip-out means is operated to allow the sash to be tipped. The linkage is deployed by the weight of the sash but is spring biased to remain folded and stowed along the sash edge until the sash is tipped out. The linkage automatically collapses for stowage against the edge of the jamb when unhooked from the jamb, which requires a deliberate manual action by the user. The distal end of the linkage defines a hook to engage the window frame or jamb at any point along the vertical traverse of the sash in the jamb, avoiding the possibility of inadvertently dropping the sash from the jamb unless the user intentionally releases the sash from the limited tip displacement at which it is retained.

Means for limiting the extent of pivoted displacement of a window-panel in a jamb are known in casement-type windows. U.S. Pat. No. 4,691,950-Mayer et al discloses a rigid one piece connecting bar which is pivoted by one end at the vertically-hinged window panel, and engages by an opposite end in an open ended slot fixed to the window jamb, which slot normally keeps the connecting bar captive by said opposite end thereof. The connecting bar can be released from the open ended slot when the window is closed by displacing the connecting bar against spring pressure such that the opposite end moves clear of the open ended slot. This must be done when first opening the casement window. In this manner, the window can be fixed part way open as defined by the connecting bar, or allowed to open completely. The connecting bar can only be manipulated into and out of the open ended slot when the window panel is pivoted closed, because the connecting bar is a rigid link element and is arranged such that the connecting bar barely has sufficient length to clear the slot when the sash is fully closed.

A stop for a pivoting window panel is also disclosed in U.S. Pat. No. 4,620,393-Stafset. In this device, a latch member can be placed over a retaining pin or released at the user's option, the latch member defining a fixed part way open position of the pivoting window panel.

With pivotally mounted window panels (i.e., casement windows), it is quite common to have not only a means for fixing the movable window panel at a particular angular displacement from the window jamb, but also to make this fixing means adjustable in length. U.S. Pat. No. 4,605,252-Yamamoto, for example, allows the user to manually position the vertically-hinged casement panel as required, and then to fix the panel at that position via an adjustably extendible connecting arm, telescoped to allow angular displacement of the window panel, and fixable at any of a plurality of different extensions at the user's option.

None of the foregoing references provides a means for fixing a tip-out sash, such that the sash slides normally, tips out when and where desired, and can only tip-out to the limited predetermined displacement unless the fixing means is first fully released by deliberate action of the user. Such an arrangement would seem to be inherently precluded because if the sash is to be movable there can be no means fixed in position on the jamb for receiving an end of a retaining bar.

A connecting member for fixing the maximum displacement of two pivotably displaced members is not readily attached to a sash or jamb which are slidably displaced, because any connecting member can be expected to interfere with operation of the sash in the sliding mode. In short, means fixing a maximum pivoted displacement of a sash are likely to interfere with sliding and means facilitating sliding are difficult to envision where the sliding structures are more complicated than pins in slots, e.g. a pin at each of the four corners of a sash, one pair of oppositely-directed pins being retractable to allow pivoting around an axis defined by the other pair of pins.

According to the invention, the foregoing conflicts are resolved without the expected drawbacks of a connecting arm between a sash and jamb. The invention enables sliding of the sash without interference, tipping of the sash at any point along its slide path, in an at least temporary releasable linkage defining a maximum extent of deflection of the sash from the jamb.

SUMMARY OF THE INVENTION

It is an object of the invention to provide a convenient and durable means for retaining the free edge of a tip-out sash panel at a predetermined maximum deflection relative to the plane of the jamb in which the sash normally slides.

It is a further object of the invention to provide a connecting member for a tip-out sash and jamb which is operable at any position of the sash within the jamb, and is easily manually disengaged.

It is a further object of the invention to provide a self-deploying and self-stowing connecting arm for fixing a tip-out sash in a window jamb.

It is still another object of the invention to include in a tip-out sash structure a means to exert increased pressure between the sash and the seals on the outdoor side of the sash/jamb when the window is shut fully.

These and other objects are accomplished by a retainer catch for a tip-out sash slidable in slots in the jamb. The window has a sash slidably captive in a window frame or jamb, such that the sash can be raised and lowered by sliding it along inward facing slots in the jamb. A releasable tenon, for example at the top edge of the sash, allows the user to rotate the sash out of the plane of the jamb, facilitating cleaning of the outside. Releasing the sash from the jamb by releasing the tenon activates a hook arm defined by the tenon such that the hook arm can pivot relative to the sash distal ends. The hook arm engages the slots in the jamb and displacement of the edge of the sash from the jamb is limited to a length defined by the pivoted hook arm. The hook arm can be released from the jamb by manual action of the user, whereupon hook arm collapses under spring biasing to reside along the edge of the sash and the sash can then pivot to any angular displacement. The hook arm can include one or more movable members. The hook arm can be controlled by a pin movable in a cam slot such that complete closure of the mechanism both extends the tenon and exerts added pressure between the sash and the outdoor-side seals.

BRIEF DESCRIPTION OF THE DRAWINGS

There are shown in the drawings the embodiments that are presently preferred. It should be understood, however, that the invention is not limited to the precise arrangements and instrumentalities shown, wherein.

DETAILED DESCRIPTION OF THE PREFERRED EMBODIMENTS

Figure 1:
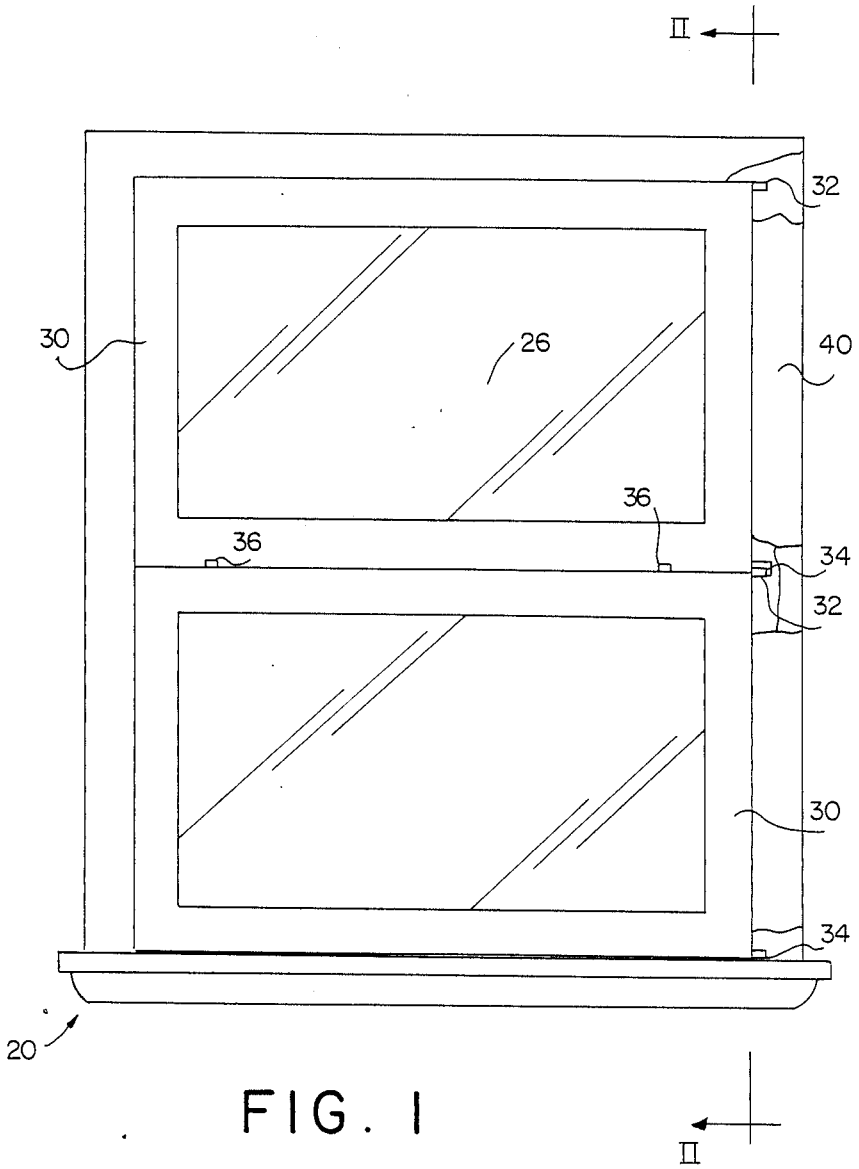
FIG. 1 is a partially cut-away elevation view of a window including a tip-out sash retaining catch according to the invention.

A tip-out sash and window jamb with a retaining catch arrangement according to the invention is shown in elevation and partly cut away in FIG. 1. At least one movable sash 30 is disposed in a frame or jamb 40, such that the sash 30 can slide along inward facing channels on either side of the jamb to open and close the window opening. Typically, two movable sashes 30 are disposed in a rectangular frame or jamb 40, such that the sashes 30 can be overlapped to open the upper or lower areas, or to partially open both. The invention is applicable to any number of sashes, or to horizontally slidable sashes, in addition to the vertically slidable embodiment shown. In a tip-out sash arrangement of this type, means protrude from the lateral edges of each sash 30, residing in the channels or slots facing inwardly toward the sash, on frame 40, such that the sash can slide while remaining in the plane of the jamb.

At least one pair of protruding members 32, 34 on opposite lateral sides of the window are releasable, whereupon the window can be rotated around an axis defined by the other pair of opposed pins. For example, top pins 32 on both opposite sides of sash 30 can be released using manually-operable means 36. Resilient bias from one or more springs urges protrusions 32 into the slots in jamb 40. When the protrusions or pins 32 on both lateral sides of one of the sash members 30 are retracted, the sash is rotated around an axis defined by pins 34 at the other end. Pins 34 also can be retractable, but preferably are fixed pins. When moving the sash back into the plane of the jamb from the tip-out position, the protrusions 32 are pressed inwardly by the jamb, and snap back into their extended state within the inward facing jamb channels.

Figure 2:
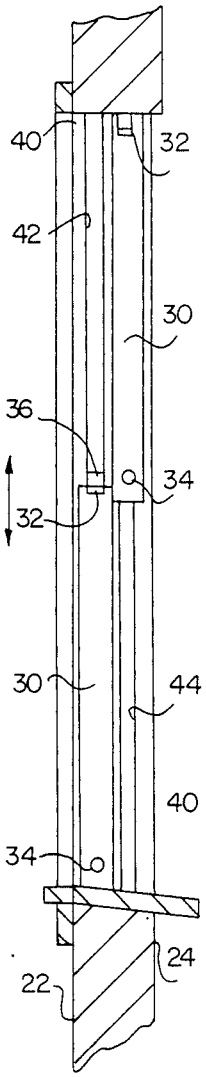
FIGS. 2, 3 and 4 are partial section views taken along lines II—II in FIG. 1, showing respective positions of the tip-out sash panels.

FIG. 2 illustrates the respective positions of the sash 30 in frame or jamb 40. The respective sashes 30 are disposed at different slots 42, 44 in ]jamb 40. The indoor-side slot 42 normally carries the lower sash 30 and the outdoor-side slot 44 carries the higher sash 30. The sashes can be lapped completely over one another and can be placed anywhere along slots 42, 44.

Figure 3:
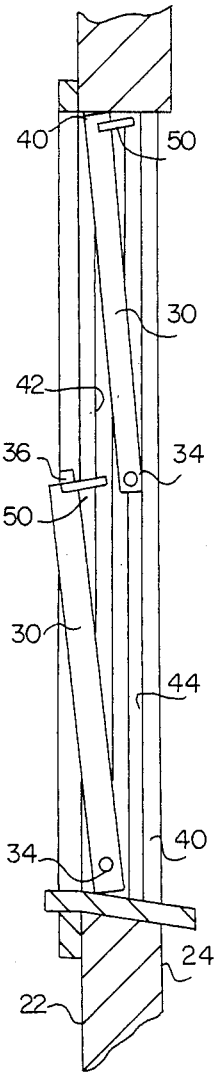

In FIG. 3, the user has retracted the protruding tenon at the upper edge of the each of the sashes 30, allowing the sashes 30 to rotate out of the plane of the jamb, around an axis defined by their respective pins 34, the latter pins remaining fixed in their respective slots 42, 44. A retention mechanism or linkage 50, however, remains engaged by its distal, hooked end in slots 42, 44, pivoting away at the edge of the sash wherever the sash may reside vertically along the slots, as the user allows sash 30 to rotate around pin 34.

In the represented example, the sashes each tilt inwardly toward inside 22, and away from outside 24 of the wall in which the window 20 is mounted. It would be possible to arrange the sashes 30 to rotate in opposite directions, or both outwardly. However, an inward rotation is preferred such that the sashes can be placed in a ventilating position, as shown in FIG. 3, protecting the interior of the building from any rain either dripping downwardly or being blown in from the sides of the window along the outside of the wall. Inward tilting also exposes the outdoor-side upwardly and is convenient for cleaning the glass of the sash 26.

Figure 4:
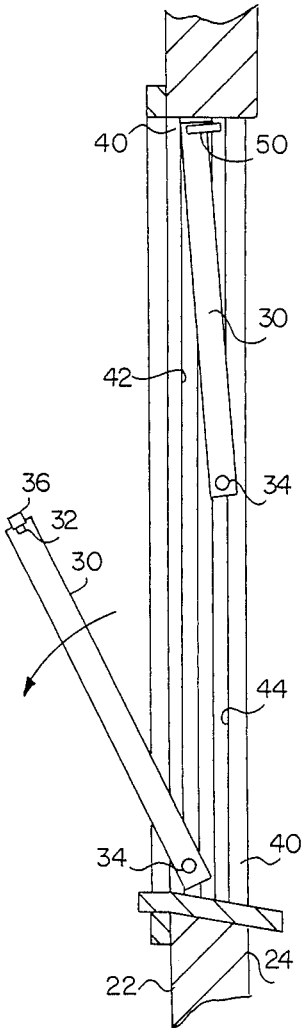

Retention mechanisms 50 are both a means defining an open deflection of the tip-out sash 30 relative to the jamb. Mechanisms 50 prevent the user from being surprised by the weight of sash 30 when sash 30 is allowed to rotate out of its normal position in jamb 40. Sash 30 can be fully released, as shown in FIG. 4, by the user manually retracting the hook end of mechanism 50 from the slot 42 or 44, in which it was engaged when self-deployed.

Figure 5:
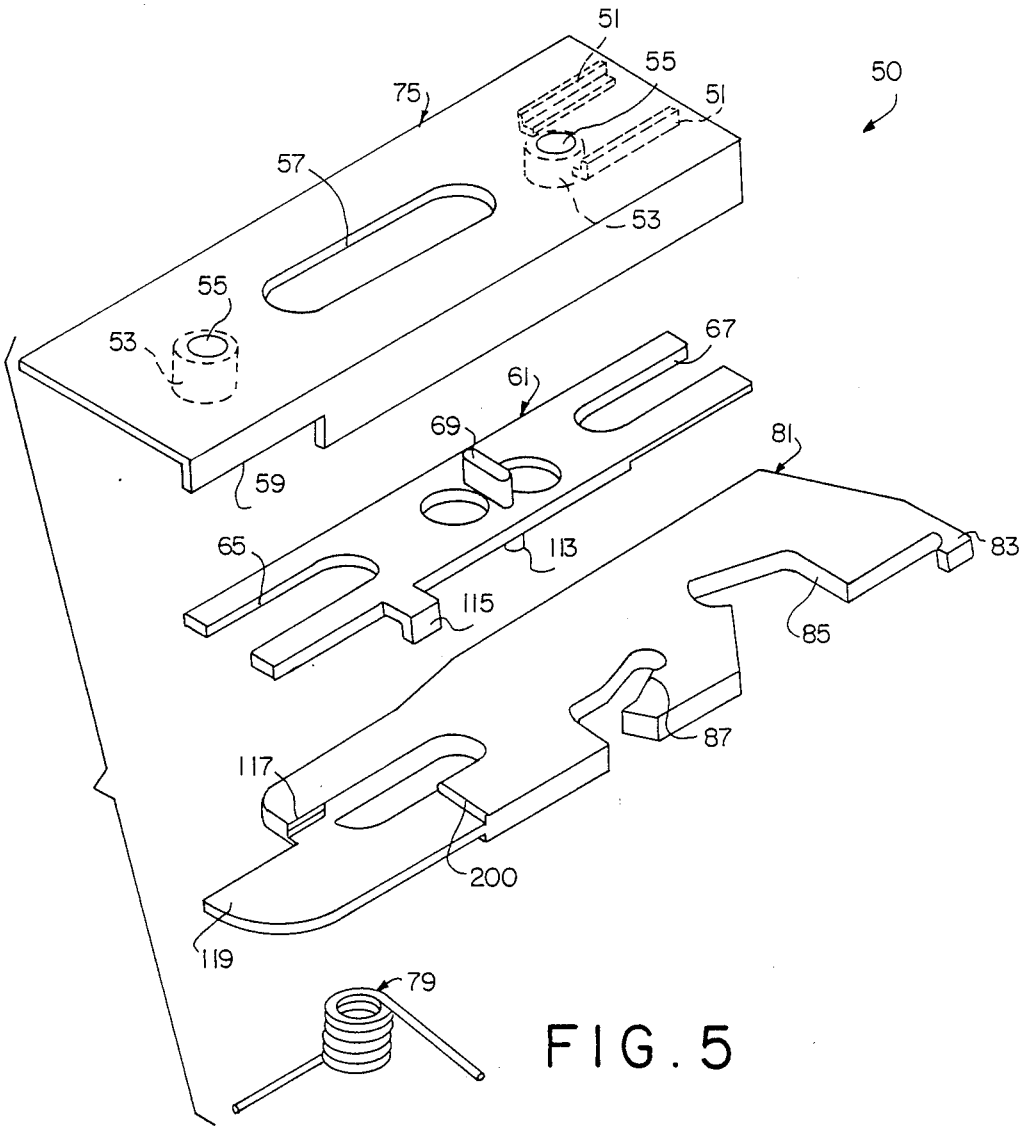
FIG. 5 is an exploded perspective view of a linkage mechanism according to the invention embodying the retaining catch.
Figure 6:
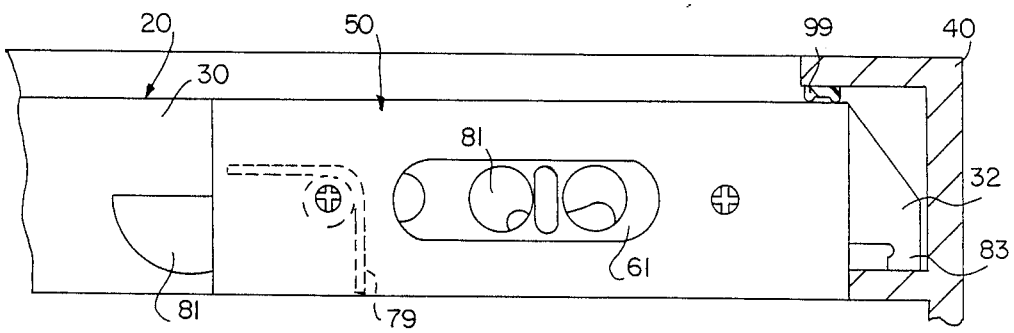
FIG. 6 is a partial section view through a window jamb, showing the linkage arranged with the window in closed position.
Figure 7:
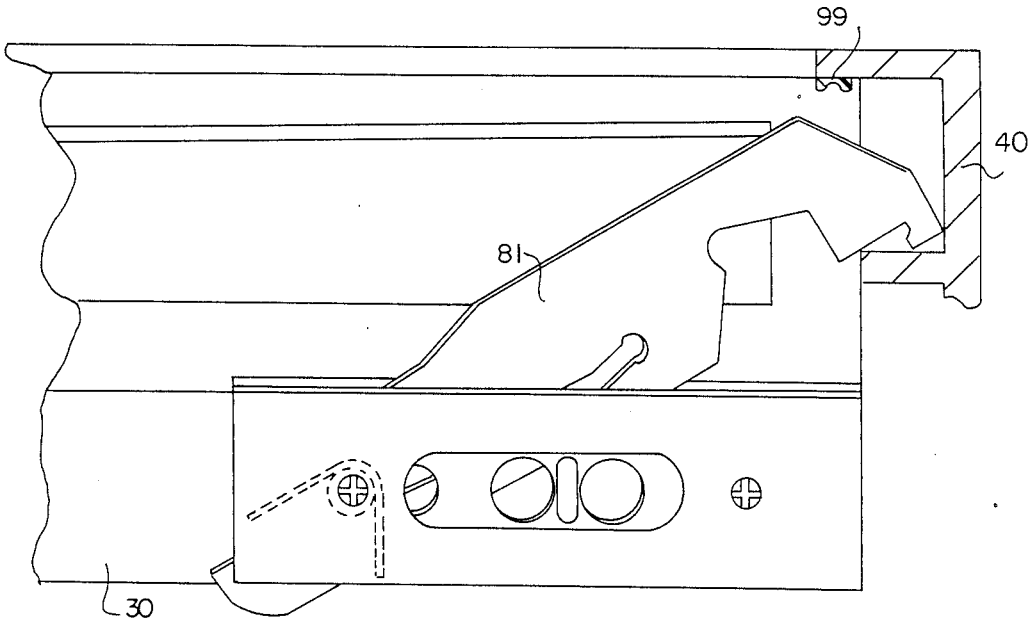
FIG. 7 is a partial section view corresponding to FIG. 6, with the linkage shown in the tipped-out retaining position.

FIGS. 5–7 show a preferred embodiment of the invention in the disassembled, stowed, and tipped-out conditions, respectively. As shown in FIG. 5, the retention mechanism 50 comprises a fixed catch cover 75, which is attached along an edge of the sash at fixed pins 55, for example, by means of screws which extend through pins 55 to attach the catch cover 75 to the sash at the upper edge. Cover 75 is spaced from the underlying material of the sash to allow clearance for catch arm 81. A control arm 61 is arranged to slide linearly back and forth as guided on the two fixed pins 55, and to control the position and release of catch arm 81, which carries a hook 83 on its distal end. Control arm 61 has a pair of end slots 65, 67, which guide along fixed pins 55, preferably having anti-friction bushings 53 which are held on fixed pins 55.

At one end the thickness of control arm 61, is reduced to engage in guide flanges 51, shown in phantom lines in FIG. 5. Pins 55 and/or bushings 53 in slots 65, 67, as well as the flanges 51, which engage around the end of control arm 61, constrain the control arm 61 to move only back and forth along a line defined by the two fixed pins 55. The user pushes the control arm inwardly (to the left in FIGS. 6 and 7) to release the sash and outwardly to fix the sash tightly against the outdoor-side seals.

A finger tab element 69 protrudes through a slot 57 located substantially at the center of the catch cover. Holes can be formed on either side of tab 69, to make the tab easier to grasp, as the user manipulates control arm 61 back and forth. The object of moving control arm 61 back and forth is to position catch arm 81 in extension from the sash, in transverse position along the sash, and to allow arm 81 to come free of the outboard side pin 55 and to pivot relative to the sash. Catch arm 81 must move along the axis defined by fixed pins 55, such that the tenon defined by hook end 83 can be forced to retract when closing the sash, and allowed to extend into slots 42, 44. Catch arm 81 must also pivot outwardly when the sash is to be tipped out, whereupon hook 83 remains at least temporarily engaged to the jamb until released by a deliberate action of the user. This motion will be described in more detail hereinafter.

Control arm 61 engages with one of the ends of biasing spring 79, a downwardly-turned tab 115 of control arm 61 resting against the end of spring 79. The spring urges control arm 61 linearly towards its right-most position as shown in FIG. 5, by one end of spring 79. The opposite end of spring 79 rests in a slot 117 on catch arm 81, and thereby biases catch arm 81 rotationally to remain in its retracted position, along the edge of sash 30.

As the catch arm 81 moves about, and control arm 61 slides back and forth, control slot 87 receives and is guided by the motion of pin 113 of control arm 61. A second opening 85 is provided for receiving one of the two fixed pins 55.

It will be appreciated that the catch mechanism shown in FIG. 5 can be the only retention mechanism on the sash, or can be one of two oppositely-directed mechanisms. The mechanism 50 can easily be operated with one hand, and it is readily possible for the user to operate the tip-out mechanism for both edges of the sash simultaneously, and also to release the connection of catch arm 81 to the window jamb with one hand. In particular, the user first pushes finger tab 69 of control arm 61 to the left (as shown in FIG. 5), to release the protruding tenon portion of catch arm 81 from within the window jamb, whereupon the tenon portion rotates and the sash tips out. The extent of tipping of the sash from the jamb is limited because the hook end 83 of catch arm 81 remains fixed to the jamb while the opposite end of catch arm 81 remains on the in-board one of the two fixed pins 55. In this situation, the sash tilts inwardly of the jamb, but is safely fixed at a slightly tilted position. In order to fully release the sash, the user supports the oblique weight of the sash and by pushing end tab 119 of catch arm 81 further into opening 59 in catch cover 75, hook 83 is pivoted free of the channel of the jamb and the sash comes free.

The respective positions of the jamb and sash are shown in FIGS. 6 and 7. In FIG. 6, the catch arm 81 is aligned parallel to a retraction line defined between the fixed pins 55. In this position, by virtue of the particular shape of slots 85, 87 in the catch arm 81, the entire sash 30 can be pressed outwardly against the outdoor-side seals on jamb 40, by pressing control arm 61 to the right. The tenon portion 32 at the end of catch arm 81 protrudes into the channel defined by jamb 40. The tenon, together with the remainder of catch arm 81, is moved also laterally of the retraction line, towards the indoor side, pushing the sash outwardly.

The interaction of control arm 61, catch arm 81 and catch cover 75 can be seen in comparing FIGS. 5, 6 and 7. When the user pushes finger tab 69 to the left as shown, pin 113 moves back from the receptacle at the extreme inside end of slot 87. A slight slope is provided along this passage of slot 87, the slope being directed to the edge of catch arm 81. Accordingly, movement of pin 113 to the left allows catch arm 81 to move toward the outdoor side relative to sash 30 (i.e., upwardly as shown in FIGS. 5 and 6). This relieves pressure between the tenon portion 32 and the indoor-side part of the channel defined by jamb 40. As a result, pressure exerted by the sash against the seal 99 on the outdoor side of jamb 40 is relieved and the sash moves more freely in jamb 40. Conversely, when finally locking the device after moving the sash or tipping out the window sash, the user can push finger tab 69 toward the lateral side of sash 30, i.e., toward jamb 40. In that event, the movement of pin 113 in slot 87 tends to pull catch arm 81 towards the indoor side relative to sash 30 (downwardly as shown in FIG. 6), thereby forcing the sash to bear more heavily against the outdoor-side seal 99 and improving effectiveness of the seal while fixing the sash tightly in place.

When tipping out the sash, the user moves finger tab 69 far enough that pin 113 reaches the right angle at the left most edge of slot 87. Continued motion of pin 113 by a tab 69 is constrained to move only along a line parallel to the line between fixed pins 55. Control arm 81 is released by pin 113 at this point, allowing catch arm 81 to rotate around the inboard fixed pin 55. The tenon portion 32, however, does not come completely clear of jamb 40 but rather as the sash begins to tilt outwardly and catch arm 81 rotates around the in-board side fixed pin 55, catch arm 81 comes clear of the outboard side pin 55, which has adequate clearance in slot 85. In so doing, pin 113 comes clear of slot 87 and mechanism 50 takes the configuration shown in FIG. 7. In this case, the catch arm 81 is held by the in-board side pin 55, and catch arm 81 is pulled as far toward the lateral edge of sash 30 (i.e., toward the right end FIGS. 6 and 7), as will be allowed by fixed pin 55. At the same time, rotation of catch arm 81 around in-board pin 55 causes spring 79 to be flexed. One end of the spring 79 resides in slot 117 of catch arm 81, and the other end rests against downwardly-turned tab 115 of control arm 61, against the edge 200 of the catch arm and against the edge of cover slot 59. Spring 79 therefore biases the catch arm 81 to remain along the edge of the jamb, and biases control arm 61 to remain as far as possible toward the right. Spring 79 can be made relatively stronger or weaker, however, the spring 79 should not be so strong as to normally pull tipped-out sash 30 back into alignment with jamb 40 by virtue of the spring having a force which exceeds the oblique weight of sash 30.

To completely release the linkage 50 from the position of FIG. 7, the user grasps sash 30 and pulls end tab 119 downwardly, causing catch arm 81 to rotate counter-clockwise in the depicted embodiment. Accordingly, hook 83 comes clear of jamb 40 and the sash weight is then supported entirely by the user.

The finger tab portion 119 of catch arm 81 is preferably made somewhat thinner than the remainder of the catch arm 81. This allows clearance for movement of the arms of spring 79 and creates edge 200, against which one end of spring 79 can bear. Surfaces of the end tab 119 preferably are displaced from the surface of catch arm 81 on both the upper and lower sides thereof, such that catch arm 81 is symmetrical and can be used on either end of the window. In addition, a slot 117 is formed on both sides of the catch arm 81 for the other end of spring 79.

Catch arm 81 is located on the bottom of the stack of parts of mechanism 50 when assembled, with one arm of spring 79 located under catch arm 81 and received in slot 117 on the lower side. The coiled portion of spring 79 resides around the in-board fixed pin 55, preferably around a bushing 53 associated therewith. The other arm of spring 79 rests against tab 115, edge 200 and the edge of cover slot 59.

The dimensions of the respective slots and the motion of catch arm 81 which the slots constrain, can be varied as necessary to accommodate specific situations. In a typical residential style window, for example, slot 87 is arranged such that over approximately a half inch (1cm) of motion along the line defined by fixed pin 55, catch arm 81 is displaced laterally due to sloping of track 87 by approximately one-tenth inch (2.5 mm). This is adequate to produce extra compression of the outdoor side seals when the window is closed, but so long as the tip-out sash is being manipulated, raised, lowered and tipped, the pressure exerted on the outdoor-side seals is reduced and the sash can be moved about more easily than if the compression applied to the seals did not change.

Preferably, the respective elements of linkage 50 according to the embodiment of FIGS. 5–7 are made of nylon. This material produces good sliding characteristics, adequate strength and very good resistance to deterioration with sun and weather. Spring 79 is preferably spring steel and pins 55 are preferably defined by tubular portions through which steel screws pass to attach linkage 50 securely to the sash 30.

Figure 8:
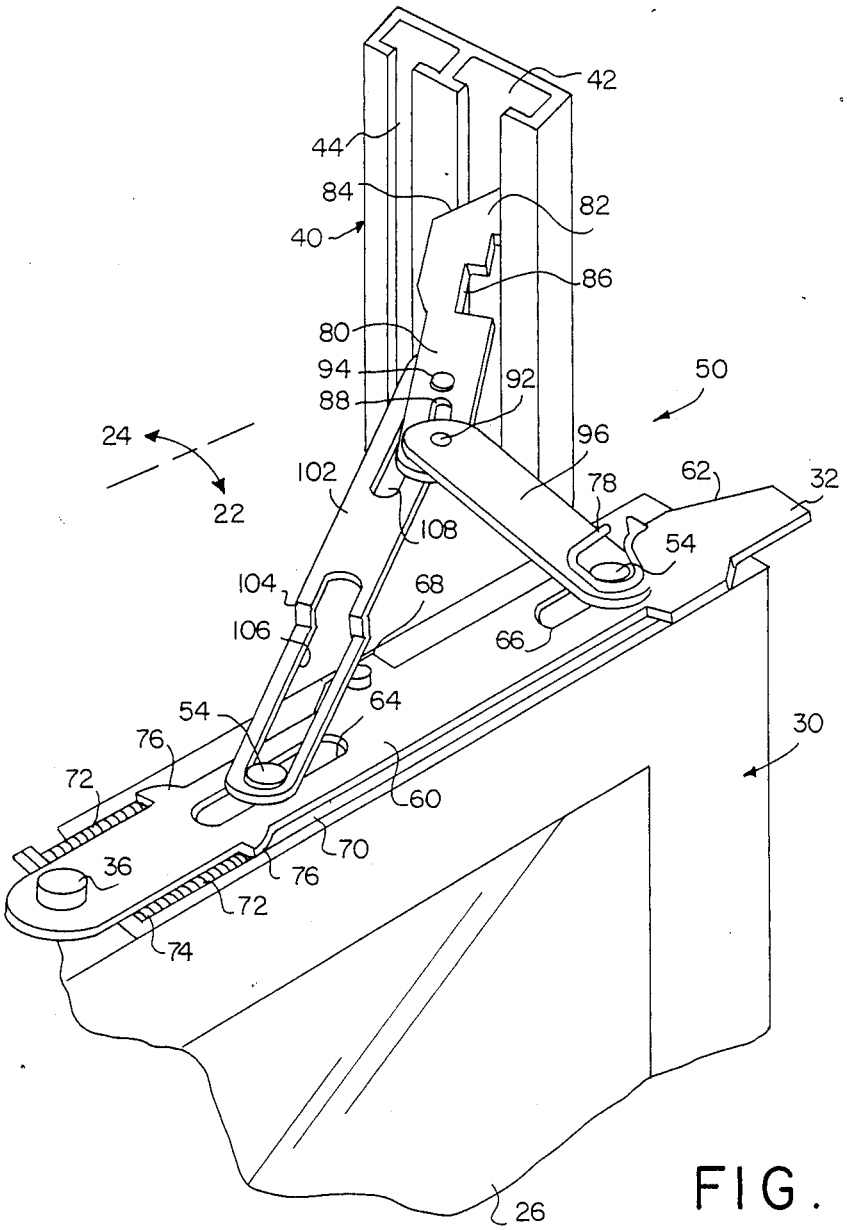
FIG. 8 is a partial perspective view showing a deployed connecting linkage according to an alternative embodiment of the invention.
Figure 9:
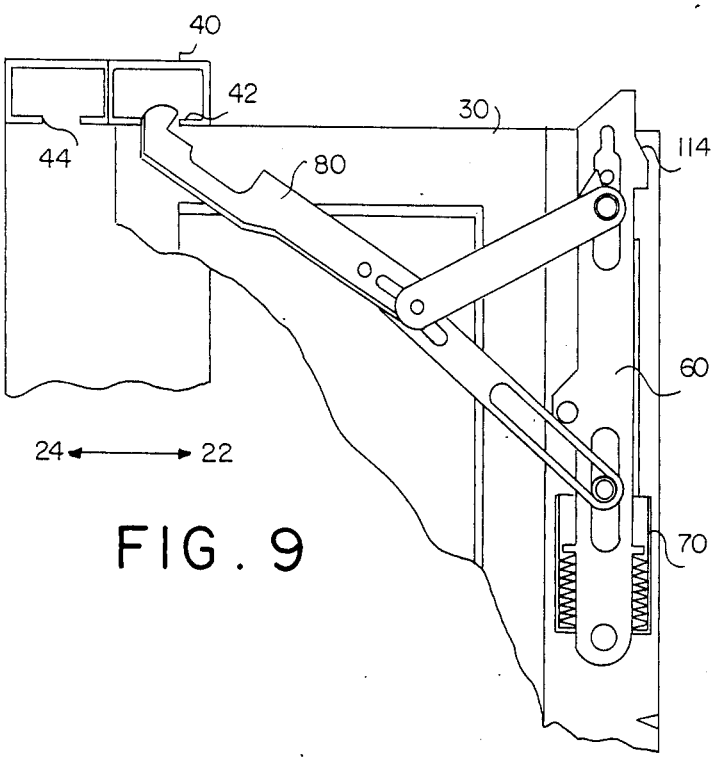
FIG. 9 is a top plan view of the deployed linkage according to the embodiment of FIG. 8.
Figure 10:
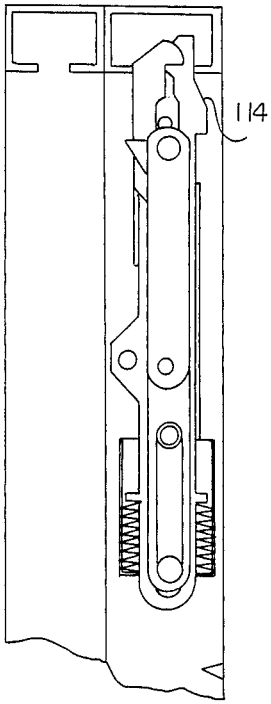
FIG. 10 is a plan view corresponding to FIG. 8, showing the alternative connecting linkage as stowed along the edge of the sash.

FIGS. 8–10 show an alternative embodiment wherein mechanism 50 is a multi-element linkage. FIGS. 8–10 show folded and unfolded positions similar to FIGS. 6 and 7. A similar mirror-symmetrical linkage can be disposed at an opposite edge of the window, only one being specifically illustrated. Linkage 50, like the embodiment of FIGS. 5–7, is directly associated with a respective protruding tenon 32, which can be released using finger pin 36 against spring pressure, or tenon 32 can be allowed to extend into slots 42 or 44 in jamb 40, for fixing the sash 30 in place. Two fixed guide pins 54 are disposed along the edge of the sash 30, for guiding the control arm 60, which terminates on the lateral edge of sash 30 in tenon 32. Slot 64, 66 by which control arm 60 spans guide pins 54, define a span sufficient to allow tenon 32 to retract completely from slot 42 or 44, and provide a latching mechanism. An edge 62 of tenon 32 is inclined relative to the jamb such that upon closing the sash by pushing the sash inwardly against frame 40, the sloping edge 62 forces control arm 60 to retract, sliding via slots 64, 66 along fixed pins 54. A resilient bias means, for example springs 72 fitted in receptacle 74, opposes retraction of the control rod 60 as the springs 72 are compressed by ears 76 of control arm 60.

Fixed pins 54 can be set into the edge of jamb 30, but preferably the pins protrude from the bottom of a box-like element received in a mortise defined in sash 30 along a top edge, whereby the control rod and linkage can be premanufactured and set into place easily as a modular part of the sash assembly.

Linkage 50 includes a hook-like catch arm 80 whose distal end hooks into slots 42, 44 of the jamb, a swing rod 96 fixing the proximal end of catch arm 80 to one of the fixed pins 54, and a pull rod 102, fixing catch arm 80 to the other of the fixed pins 54. Each of linkage elements 80, 96, 102 is pivotally connected in a manner that will allow the linkage to extend as shown in FIGS. 5 and 6, or to retract as shown in FIG. 7. Preferably, a telescoping arrangement is provided such that the linkage elements pivot and slide over one another. The hinge pins 92, 94 connecting elements 96, 80 and 102 are for this purpose received in elongated slots whereby the linked parts can telescope over one another, occupying a shorter length along the edge of sash 30 when stowed than the linkage elements define when deployed. A rotary spring element 78, fixed to the outboard one of fixed pins 54, urges swing rod 96 counterclockwise as shown to pull catch arm 80 back toward the edge o sash 30. Pin 92, connecting swing rod 96 and catch arm 80, then slides to the end of slot 88 in catch arm 80. Normally, the weight of the sash 30 causes pins 92, 94 to remain at the extreme ends of slots 88, 108, respectively, and also causes the fixed pin 54 on the inboard side of sash 30 to reside at the extreme end of elongated slot 106 in pull rod 102. When the user relieves this weight, however, by disengaging catch arm 80 from slot 42, 44 or by pushing sash 30 back toward the plane of the jamb, then rotation of swing rod 96 around the outboard pin 54 pulls pin 94 downwardly along slot 108, and with further motion, causes pull rod 102 to slide back such that inboard pin 54 slides into the intermediate area of slot 106.

Pull rod 102 has an intermediate step 104. When pull rod 102 is retracted, step 104 allows pull rod 102 to rotate freely around inboard pin 54, without interference from stop pin 68 on control rod 60. However, when extended as shown in FIG. 9, pin 68 prevents pull rod 102 from rotating. In this manner, sash 30 is securely supported at its fixed partially-open position leaning toward inside 22 and away from outside 24. As the linkage collapses when released from the jamb, at a point where stop pin 68 clears slot 106, swing rod 96 draws pull rod 102 into a position substantially co-linear with control rod 60. In this case, the hook 82 at the extreme end of catch arm 80 rests immediately over tenon 62, in fact defining a part of the protruding tenon structure. The sloped rear edge 84 of catch arm 80 is then positioned immediately over the sloped rear edge 62 of tenon 32 such that these parts move as one.

A clearance opening 86 is defined on catch arm 80, spaced slightly inwardly from the hook 82. This clearance area 86 accommodates the outboard fixed pin 54 as catch arm 80 moves about. Swing rod 96 is spaced somewhat upwardly from the top surface of control rod 60, this space for example being occupied by spring 78, in the form of a helical spring and/or by washers or bushings. Accordingly, as the device collapses, catch arm 80 engages neatly around fixed pin 74, the entire device being folded compactly as shown in FIG. 10, being stowed by action of its spring 78. A second rotary spring (not shown) can be mounted at the other one of the fixed pins 54, urging pull rod 102 clockwise in the illustrated embodiment, further assisting the self-stowage of mechanism 50.

Slot 88, formed between the connection of swing rod 96 and catch arm 80, is dimensioned to allow retraction of catch arm 80 together with tenon 32. Accordingly, slot 88 has enough span to permit inward movement equal to the protruding length of tenon 32.

Preferably, control rod 60 is not simply retractable and extendible to the point shown in FIG. 9. In addition, means may be provided for urging an extra extension of control rod 60 into slot 42 or 44, causing a second and wider inclined surface 114 to bear against inward facing edges of slot 42 or 44, more-tightly engaging the sash in the frame when desired. In this way, control rod 60 also provides a means for better sealing sash 30 on the outdoor side, but restricting the ease at which slides along jamb 40.

Extension of control rod 60 to the point at which slope 114 contacts slot 42 or 44 can be controlled by springs 72 bearing against ears 76 of control rod 60 and against the inward edges of box 74. Alternatively, the control rod 60 can be provided with additional stop elements, whereby the user can fix control rod 60 at an unusual extension more tightly engaging the jamb.

The respective connecting rod elements are preferably formed of nylon, but can also be sheet metal, e.g., aluminum, and may receive steel dowel pins for the stops 36, 68 and connecting pins 92, 94, etc. Preferably, fixed pins 64 are at least provided with nylon sleeves or bushings for smooth operation.

According to the invention in either embodiment, a user who inadvertently disengages tenon 32 from slot 42 or 44 is protected by the engagement of the hook and the jamb prior to sash 30 falling completely free of the jamb at the top edge of sash 30. The extent of displacement of sash 30 when the apparatus catches in the frame 40 is preferably a relatively small angle. The angle will vary with the vertical length of the sash and may be, for example 3°–15°, and preferably on the order of 4° for a typical sash. Such a small deflection is enough to allow access to the catch hook to release the sash, allows the user to appreciate the mass of sash 30 by feeling the oblique weight of the sash, and has a small cosine wherefore the weight is not so great as to apply a large force to the jamb through the linkage 50 and/or to the user.

The invention as so disclosed is a tip-out window apparatus for a sash 30 slidable in a jamb 40, the sash having at least two spaced protruding parts 32, 34 along an edge abutting the jamb and the jamb having a slot 42 for receiving the protruding parts, whereby the sash is slidable in the jamb in a first, normal mode to open and close the window as the sash is maintained in a same plane with the jamb, one of the protruding parts 32 being a releasable latch means 50, the sash being released and rendered rotatable around the other 34 of the protruding parts and out of said plane when the latch means 50 is retracted in a second, tip-out mode.

A catch arm 81, 80 having a hook 83, 82 at a distal end of the catch arm is engageable in the jamb and is pivotably connected at a proximal end relative to the sash, the catch arm defining a maximum displacement between the jamb and the edge of the sash when the sash is released from the plane of the jamb in said tip-out mode, and the catch arm being fully releasable from the jamb by pivoting free the hook.

The catch arm 81, 80 is linearly movable along two fixed pins 55, 54 disposed at an edge of the sash and rotatable around an in-board one of said pins, in said tip-out mode. A control arm 61, 62 is linearly movable along said fixed pins, the control arm having a pin 68, 113 guided in a slot 87, 106 for manipulating said catch arm. The slot 87 on the catch arm 81 has a section inclined to displace the sash toward indoor and outdoor sides of the window, whereby upon closing the tip-out apparatus, the sash can be pressed more tightly against outdoor-side seals 99 therefor. A spring 79 biases said catch arm to remain in a stowed position along an edge of the sash. The spring 79 is a coil spring disposed on said inboard-side fixed pin, the coil spring having arms disposed against the catch arm to keep the catch arm pulled into a stowed position, and against the control arm 61, to force the control arm toward a closed-sash position. A catch cover 75 is affixed to the sash by screws through said two fixed pins 55, the sash cover having a central opening 57 defining an access hole for manipulating the control arm 61, the catch cover also having openings for clearance of the catch arm in the stowed and tipped out positions. The control arm 61 has an upwardly protruding finger tab 69 protruding through said opening 57 in the catch cover 61, and a downwardly protruding control pin 113 engageable in said slot 87 in the catch arm.

The mechanism 50 can have a pull rod 102 and a swing rod 96 pivotably disposed to connect the catch arm 80 relative to the sash 30, the pull rod and the swing rod being pivoted to the sash by one of their respective ends at spaced pivot axes 54 along the sash, and pivoted to the catch arm by opposite ones of their respective ends. The apparatus includes a control rod 60 having an end defining said protruding part in a form of a tenon 32 extendible into the slot 44 of the jamb, and further includes resilient means biasing the control rod to extend, the control rod being manually retractable to disengage the sash and the jamb. The catch arm 80, swing rod 96 and pull rod 102 are pivotably collapsible to overlay one another in a stowed position along an edge of the sash. At least one pivotable connection between connected members defined by the catch arm, the swing rod, the pull rod and said one of the sash and the jamb includes a pin 68 on one of the connected members, slidable and pivotable on an elongated slot 106 in another of said connected members, whereby the connected members are linearly collapsible over one another. The control rod is linearly slidable on two fixed pins disposed on a horizontal edge of the sash, the two pins defining said spaced pivot axes for the swing rod and the pull rod. The control rod has a stop pin 68 protruding from a top of the control rod and intersecting a path of the pull rod, the pull rod having a bend 104 arranged such that the pull rod passes over the stop pin on the control rod only when the pull rod is extended to place the bend beyond the stop pin.

The invention can also be defined as a window having a sash 30 disposed in a jamb 40, the sash 30 and the jamb 40 having complementary structures whereby the sash in one mode is maintained in a plane of the jamb, and in a second mode is displaceable from the plane of the jamb, a latch means 50 being mounted on the sash controllably to fix the sash in the jamb, the latch means including at least one extendible and retractable tenon 32 for bridging between the sash and the jamb, the tenon when retracted releasing the sash from the jamb at least at one edge of the sash, and, a catch arm including a hook 83, 82 at a distal end of a catch arm, engageable in the jamb and being connected at a proximal end to the sash, the catch arm defining a maximum displacement between the jamb and the edge of the sash when the sash is released from the plane of the jamb. The catch arm 81, 80 is foldably collapsible for stowing the catch arm along an edge of the sash, and is operable to engage the hook in the jamb when the latch means is operated, and manually releasable by pivoting the hook free of the jamb.

The invention having been disclosed, additional embodiments and variations are possible within the scope of the invention, and will now become apparent to persons skilled in the art. Reference should be made to the appended claims rather than the foregoing specification as indicating the scope of the invention in which exclusive rights are claimed.

I claim:

1. A tip-out window apparatus for a sash slidable in a jamb, comprising:

at least two spaced protruding parts for mounting along an edge abutting the jamb at a slot in the jamb for receiving the protruding parts, whereby the sash is slidable in the jamb in a first, normal mode to open and close the window as the sash is maintained in a same plane with the jamb, one of the protruding parts being a releasable latch means, the sash being released and rendered rotatable around the other of the protruding parts and out of said plane when the latch means is retracted in a second, tip-out mode; and, a catch arm having a hook at a distal end of the catch arm, the hook being engageable in the jamb and being pivotably connected relative to the sash at a proximal end of the catch arm, the catch arm defining a maximum displacement between the jamb and the edge of the sash when the sash is released from the plane of the jamb in said tip-out mode, and the catch arm being fully releasable from the jamb by pivoting free the hook.

2. The tip-out window apparatus of claim 1, wherein the catch arm is linearly movable along two fixed pins disposed at an edge of the sash and rotatable around an in-board one of said pins, in said tip-out mode.

3. The tip-out window apparatus of claim 2, further comprising a control arm linearly movable between said fixed pins, the control arm having a pin guided in a slot on the catch arm for manipulating said catch arm.

4. The tip-out window apparatus of claim 3, wherein the slot on the catch arm has a section inclined to displace the sash toward indoor and outdoor sides of the window, whereby upon closing the tip-out apparatus, the sash can be pressed more tightly against outdoor-side seals therefor.

5. The tip-out window apparatus of claim 4, further comprising a spring biasing said catch arm to remain in a stowed position along an edge of the sash.

6. The tip-out window apparatus of claim 5, wherein the spring is a coil spring disposed on said inboard-side fixed pin, the coil spring having arms disposed against the catch arm to keep the catch arm pulled into a stowed position, and against the control arm, to force the control arm toward a closed-sash position.

7. The tip-out window apparatus of claim 6, further comprising a catch cover, the catch cover being affixed to the sash by screws through said two fixed pins, the catch cover having a central opening defining an access hole for manipulating the control arm, the catch cover also having openings for clearance of the catch arm in the stowed and tipped out positions.

8. The tip-out window apparatus of claim 7, wherein said control arm has an upwardly protruding finger tab protruding through said opening in the catch cover, and a downwardly protruding control pin engageable in said slot in the catch arm.

9. The tip-out window apparatus of claim 3, further comprising a pull rod and a swing rod pivotably disposed to connect the catch mechanism relative to the sash, the pull rod and the swing rod being pivoted to the sash by one of their respective ends at spaced pivot axes along the sash, and pivoted to the catch rod by opposite ones of their respective ends.

10. The tip-out window apparatus of claim 9, wherein the appartus includes a control rod having an end defining said protruding part in a form of a tenon extendible into the slot of the jamb, and further comprising resilient means biasing the control rod to extend, the control rod being manually retractable to disengage the sash and the jamb.

11. The tip-out window apparatus of claim 9, wherein the catch arm, swing rod and pull rod are pivotably collapsible to overlay one another in a stowed position along an edge of the sash.

12. The tip-out window apparatus of claim 9, wherein at least one pivotable connection between connected members defined by the catch arm, the swing rod, the pull rod and said one of the sash and the jamb includes a pin on one of the connected members, slidable and pivotable on an elongated slot in another of said connected members, whereby the connected members are linearly collapsible over one another.

13. The tip-out window apparatus of claim 9, wherein the control rod is linearly slidable on two fixed pins disposed on a horizontal edge of the sash, the two pins defining said spaced pivot axes for the swing rod and the pull rod.

14. The tip-out window apparatus of claim 9, wherein the control rod has a stop pin protruding from a top of the control rod and intersecting a path of the pull rod, the pull rod having a bend arranged such that the pull rod passes over the stop pin on he control rod only when the pull rod is extended to place the bend beyond the stop pin.

15. The tip-out window apparatus of claim 9, further comprising at least one spring biasing one of the pull rod and the swing rod into alignment with the control rod, whereby the apparatus tends to return to a stowed position when the catch rod is released from the jamb.

16. The tip-out window apparatus of claim 9, wherein the catch rod is telescopable with the pull rod and the swing rod is biased to retract the catch rod along the pull rod.

17. A tip-out window, comprising:

a sash disposed in a jamb, the sash and the jamb having complementary structures whereby the sash in one mode is maintained in a plane of the jamb, and in a second mode is displaceable from the plane of the jamb;

a latch means mounted on the sash for controllably fixing the sash in the jamb, the latch means including at least one extendible and retractable tenon for bridging between the sash and the jamb, the tenon when retracted releasing the sash from the jamb at least at one edge of the sash; and, a catch mechanism including a hook at a distal end of the catch mechanism, engageable in the jamb and being connected at a proximal end relative to the sash, the catch mechanism defining an at least temporary maximum displacement between the jamb and the edge of the sash when the sash is released from the plane of the jamb, the catch mechanism having a catch arm collapsible for stowing the catch mechanism along an edge of the sash, and being operable to engage the hook in the jamb when the latch means is operated, and manually releasable by pivoting the hook free of the jamb.

18. The tip-out window apparatus of claim 17, wherein the catch arm is attached relative to a pair of fixed pins on an edge of the sash, the catch arm being linearly movable for a limited displacement along said pins, and the catch arm being rotatable around an in-board one of the pins, free of an out-board one of the pins, when the sash is tipped out.

19. The tip-out window apparatus of claim 17, further comprising a biasing spring connected to the catch arm and operable to retract the catch member against weight of the sash.

20. The tip-out window apparatus of claim 17, further comprising a control arm having guide means engaging said fixed pins for restraining the control arm to move along a line defined by the two pins, the control arm having at least one pin protruding into a guide slot in the catch arm, for controlling at least one of retraction and displacement of the catch arm.

21. The tip-out window apparatus of claim 20, further comprising a catch cover, the catch cover being attached to the sash by means of said fixed pins, and having a slot for receiving a manually-accessible protruding portion of the control arm.

22. The tip-out window apparatus of claim 20, wherein the control arm has an upwardly protruding finger tab, a downwardly protruding guide pin slidable in a guide slot in the control arm, and a downwardly protruding spring flange, bearing against said biasing spring.

23. The tip-out window apparatus of claim 22, wherein an opposite end of said spring bears against the catch arm, at a slot disposed adjacent the in-board fixed pin.

24. The tip-out window apparatus of claim 20, wherein the guide means on the catch arm has a portion inclined relative to said line between the fixed pins, said inclined portion guiding an inwardly displacement of the catch arm at full extension of the control arm, whereby upon said full extension, extra pressure is exerted against outdoor-side seals along the sash.

25. The tip-out window apparatus of claim 17, wherein the catch mechanism includes a catch arm with the hook at one end and a pull rod and a swing rod pivotably disposed to connect an opposite end of the catch arm relative to the sash, the pull rod and the swing rod being pivoted to the sash by one of their respective ends at spaced pivot axes along the sash, and pivoted to the catch arm by opposite ones of their respective ends.

26. The tip-out window mount apparatus of claim 17, wherein the latch means includes a control rod having an end defining a tenon extendible to bridge from the sash to the jamb, and further comprising at least one spring bearing against the sash and against the control rod, biasing the control rod to extend, the control rod being manually retractable against force of the spring to disengage the sash and the jamb.

27. The tip-out window mount apparatus of claim 26, wherein at least one pivotable connection between connected members of the catch mechanism attached to the sash is defined by a pin on one of the connected members, slidable and pivotable on an elongated slot in another of said connected members.

28. The tip-out window mount apparatus of claim 26, wherein the control rod is linearly slidable on two pins mounted in the sash, the control rod being extendible into a mortise in the jamb, the two pins defining said spaced pivot axes for the swing rod and the pull rod, and further comprising at least one stop restricting pivoting of one of the swing rod and the pull rod, the stop being operable to restrict pivoting when said one of the swing rod and the pull rod are inclined relative to the catch rod.

29. The window mount apparatus of claim 17, wherein the control rod is linearly slidable on two pins mounted in the sash, the control rod being extendible into a mortise in the jamb, the two pins defining said spaced pivot axes for the swing rod and the pull rod, the swing rod being pivoted to one of the pins disposed closer to the tenon and the pull rod being pivoted to the other of the pins, located more remote from the tenon, and further comprising at least one stop pin adjacent to the swing rod pivot axis, restricting pivoting of the swing rod beyond a predetermined extent of deflection.

30. The window mount apparatus of claim 29, further comprising a stop pin on the control rod, engageable against the pull rod at full displacement of the sash from the jamb.

* * * * *